US008118070B2

(12) United States Patent
Smith

(10) Patent No.: US 8,118,070 B2
(45) Date of Patent: Feb. 21, 2012

(54) DISCONNECT VALVE FOR GRAVITY FED PAINT HOPPERS

(75) Inventor: Jeffrey Mark Smith, New Market, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 1016 days.

(21) Appl. No.: 11/772,683

(22) Filed: Jul. 2, 2007

(65) Prior Publication Data

US 2009/0008589 A1 Jan. 8, 2009

(51) Int. Cl.
*B05B 9/00* (2006.01)

(52) U.S. Cl. ..... 141/349; 141/335; 141/336; 141/364; 239/379

(58) Field of Classification Search ..... 141/335–336, 141/348–349, 351, 363–364; 239/379
See application file for complete search history.

(56) References Cited

U.S. PATENT DOCUMENTS

| | | | | | |
|---|---|---|---|---|---|
| 748,988 | A * | 1/1904 | Schaper | 141/335 |
| 2,868,246 | A * | 1/1959 | Nelson | 141/335 |
| 5,031,676 | A * | 7/1991 | Ulm | 141/346 |
| 5,232,125 | A * | 8/1993 | Adams | 141/363 |
| 5,273,083 | A * | 12/1993 | Burrows | 141/346 |
| 5,370,270 | A * | 12/1994 | Adams et al. | 141/363 |
| 5,402,836 | A * | 4/1995 | Hasper et al. | 141/364 |
| 5,431,205 | A * | 7/1995 | Gebhard | 141/351 |
| 7,018,181 | B2 * | 3/2006 | Cooper et al. | 417/470 |
| 7,299,956 | B2 * | 11/2007 | Haglund et al. | 141/364 |
| 7,513,278 | B2 * | 4/2009 | Hengsperger et al. | 141/335 |

* cited by examiner

*Primary Examiner* — Gregory Huson
*Assistant Examiner* — Nicolas A Arnett
(74) *Attorney, Agent, or Firm* — Westman Champlin & Kelly

(57) ABSTRACT

A disconnect apparatus for a gravity fed hopper for a paint spray pump includes a valve that automatically opens when the hopper outlet is attached to an inlet of the pump and closes when the hopper outlet is detached from the pump inlet. A structure for wiping the interior of the outlet may be provided to remove material from the outlet as the hopper is separated from the pump.

2 Claims, 20 Drawing Sheets

DISCONNECT VALVE FOR GRAVITY FED PAINT HOPPERS

BACKGROUND OF THE INVENTION

The present invention relates to the field of paint sprayers, more particularly to paint spray pumps having a gravity fed paint hopper to deliver paint to the pump. Some prior art systems did not have a convenient way to remove the hopper from the pump; consequently, during clean-up of the equipment after spraying water-based paint, the electric motor associated with the pump was undesirably subjected to water spray used to clean the hopper. Even if the user desired to remove the hopper from the pump for clean-up in such prior art systems, there typically was no convenient means to shut off paint from the hopper when the hopper was removed from the pump. Since the paint was fed from the hopper to the pump by gravity, removing the hopper would allow paint to leak from the hopper once the hopper outlet was separated from the pump inlet.

BRIEF SUMMARY OF THE INVENTION

The present invention overcomes this shortcoming of the prior art by providing a removable hopper with an automatic shut-off that closes the hopper outlet when the hopper is removed from the pump inlet below the hopper outlet. This enables a user, for example, to conveniently return unused paint remaining in the hopper to a storage container, and makes it easier and more convenient for the user to clean-up the hopper after spraying is completed. In addition, in at least one embodiment, residual paint remaining on the outlet may be automatically wiped off in the process of separating the hopper outlet from the pump inlet, eliminating or at least reducing the potential for paint to drip off the hopper outlet once it is separated from the pump inlet.

In one aspect of the present invention, a valve closes automatically when the hopper outlet is separated from the pump inlet. The valve may be held open (for gravity feeding of the paint when the hopper is connected to the pump inlet) by a projection extending from a structure subjacent the hopper outlet and attached to the pump inlet.

In another aspect, paint remaining on the hopper outlet is wiped off the outlet as the hopper is removed. The projection which operates the valve may support a wiper to accomplish this aspect of the invention. In one form, the outlet may be a conical extension, and, in another embodiment, the outlet may be a cylindrical extension.

DETAILED DESCRIPTION OF THE INVENTION

Referring now to the Figures, and most particularly to FIGS. 1-4, a prior art paint spray pump assembly 10 may be seen. Pump assembly 10 preferably includes an electric motor driven pump 12 located below a paint hopper 14. The various details of assembly 10 are shown and described in commonly assigned U.S. Pat. No. 7,018,181, the entire contents of which are hereby expressly incorporated by reference.

Figure 1:
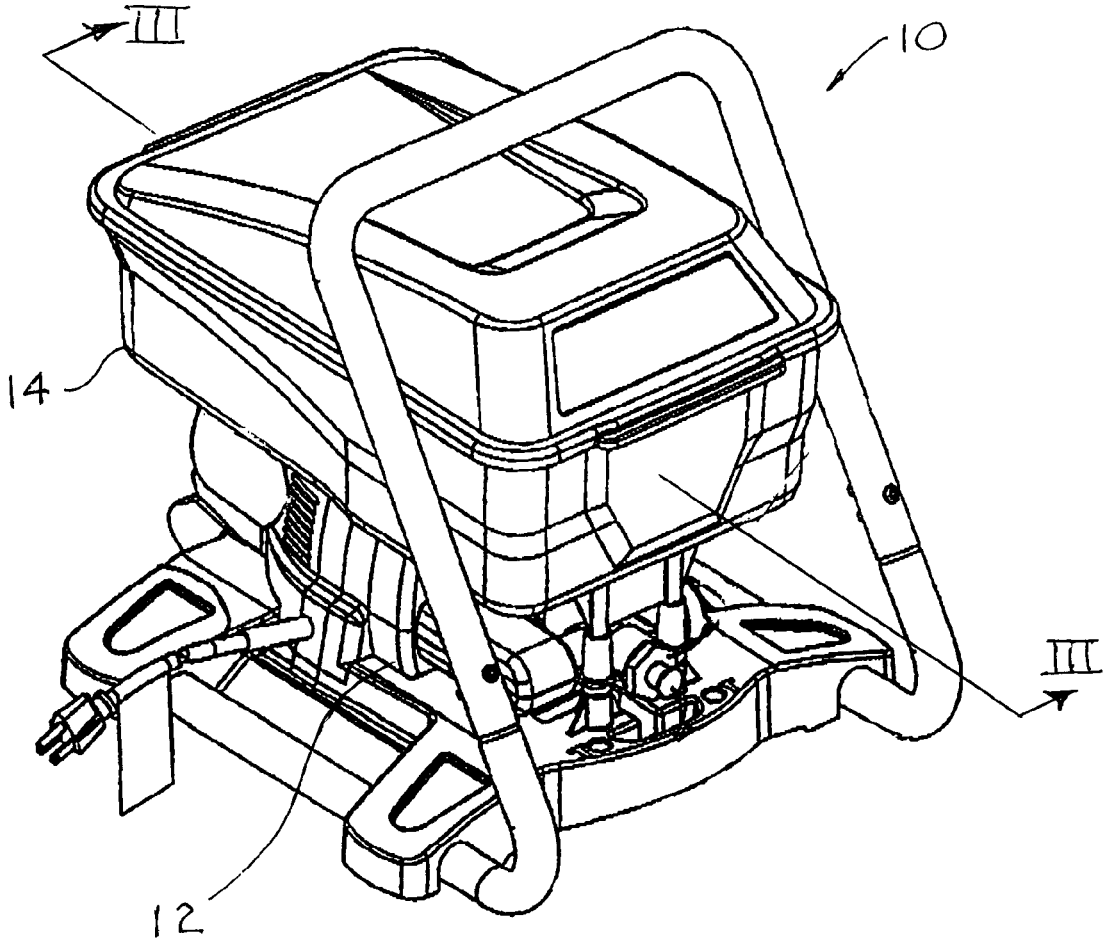
Fig. 1 PRIOR ART
FIG. 1 is a perspective view from above and to the left of a prior art paint spray pump and hopper.
Figure 2:
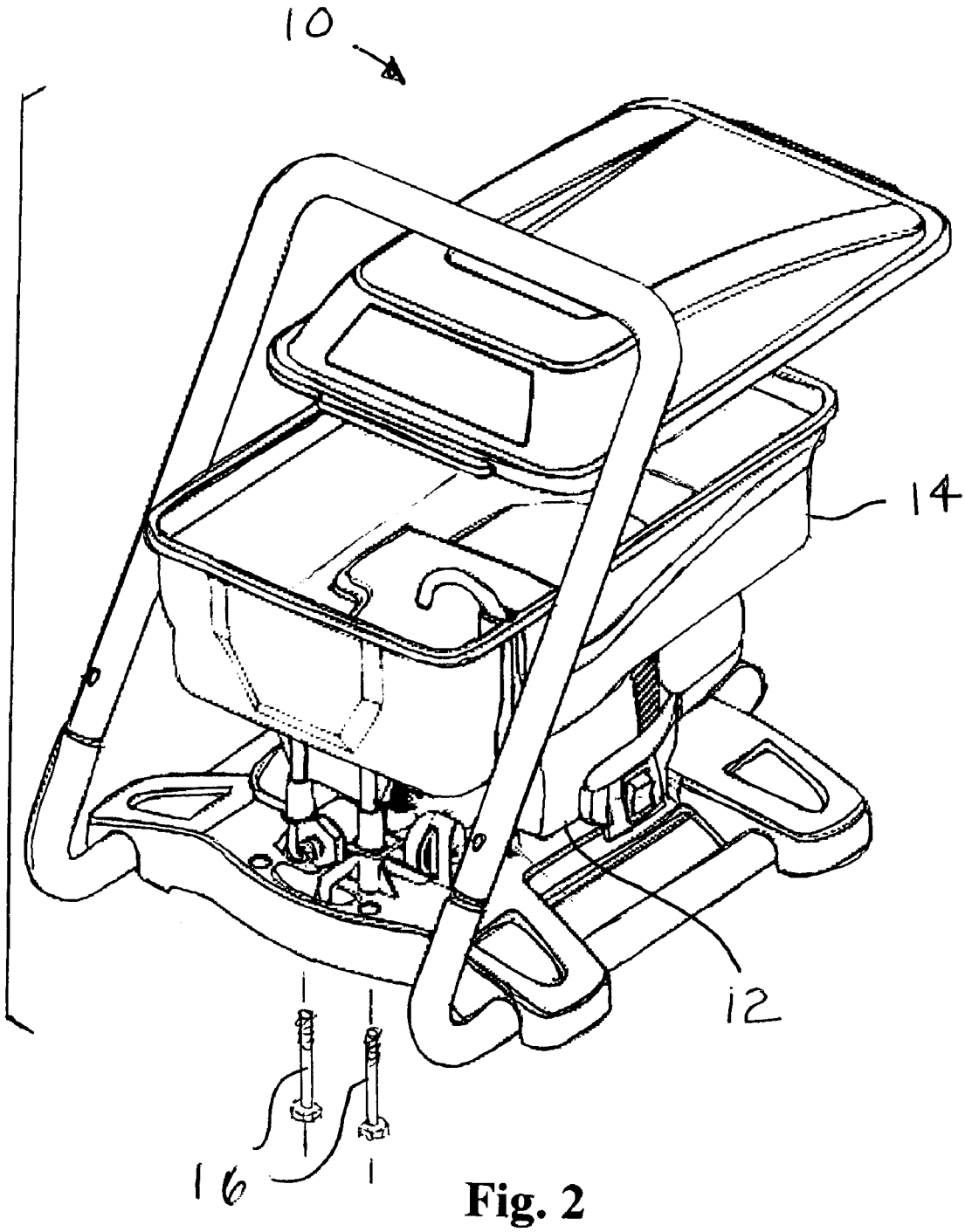
Fig. 2 PRIOR ART
FIG. 2 is a view similar to that of FIG. 1, except from above and to the right and with a lid displaced from the hopper.
Figure 3:
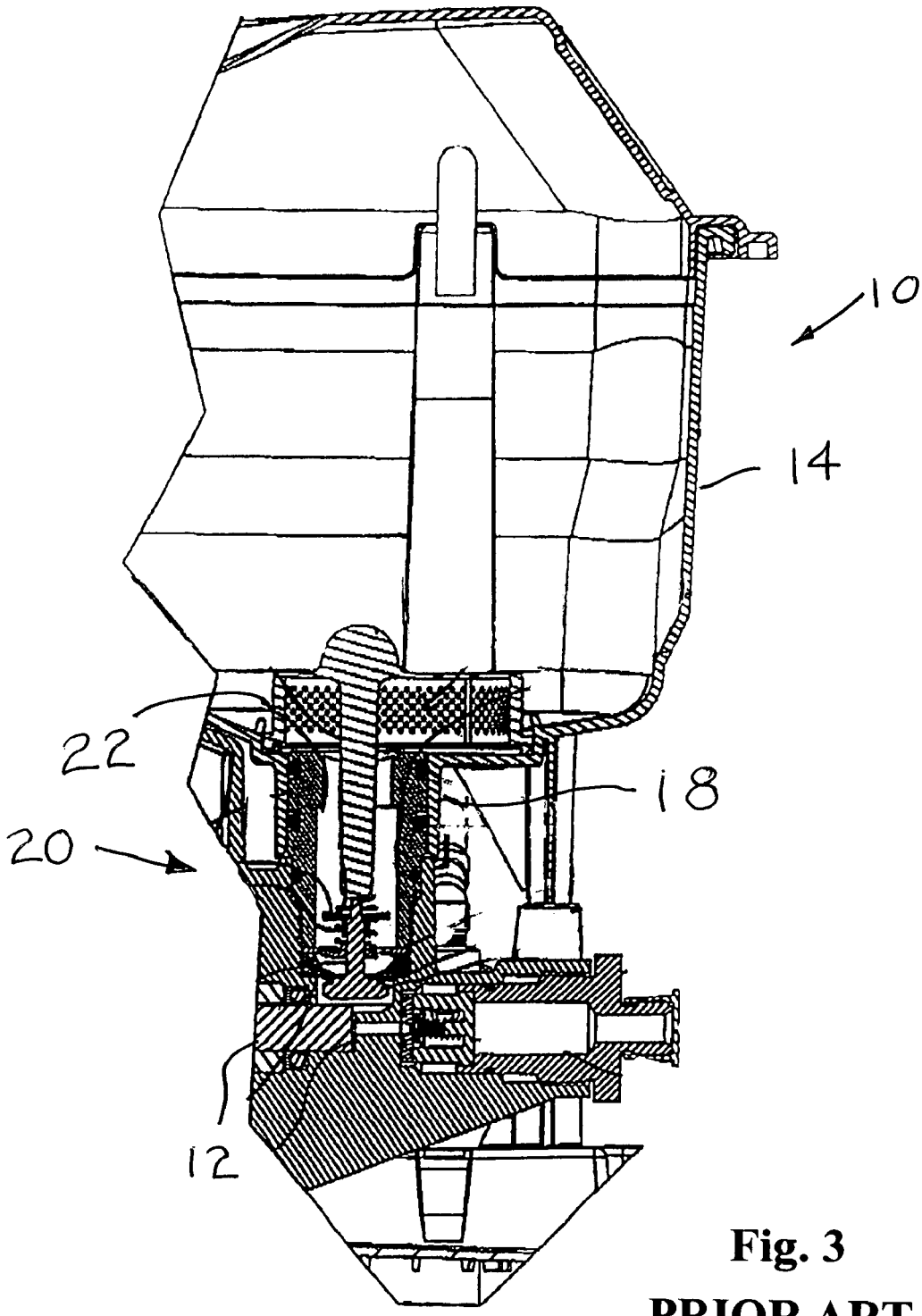
Fig. 3 PRIOR ART
FIG. 3 is a fragmentary section view of the prior art pump and hopper shown in FIG. 1, taken along line III-III.
Figure 4:
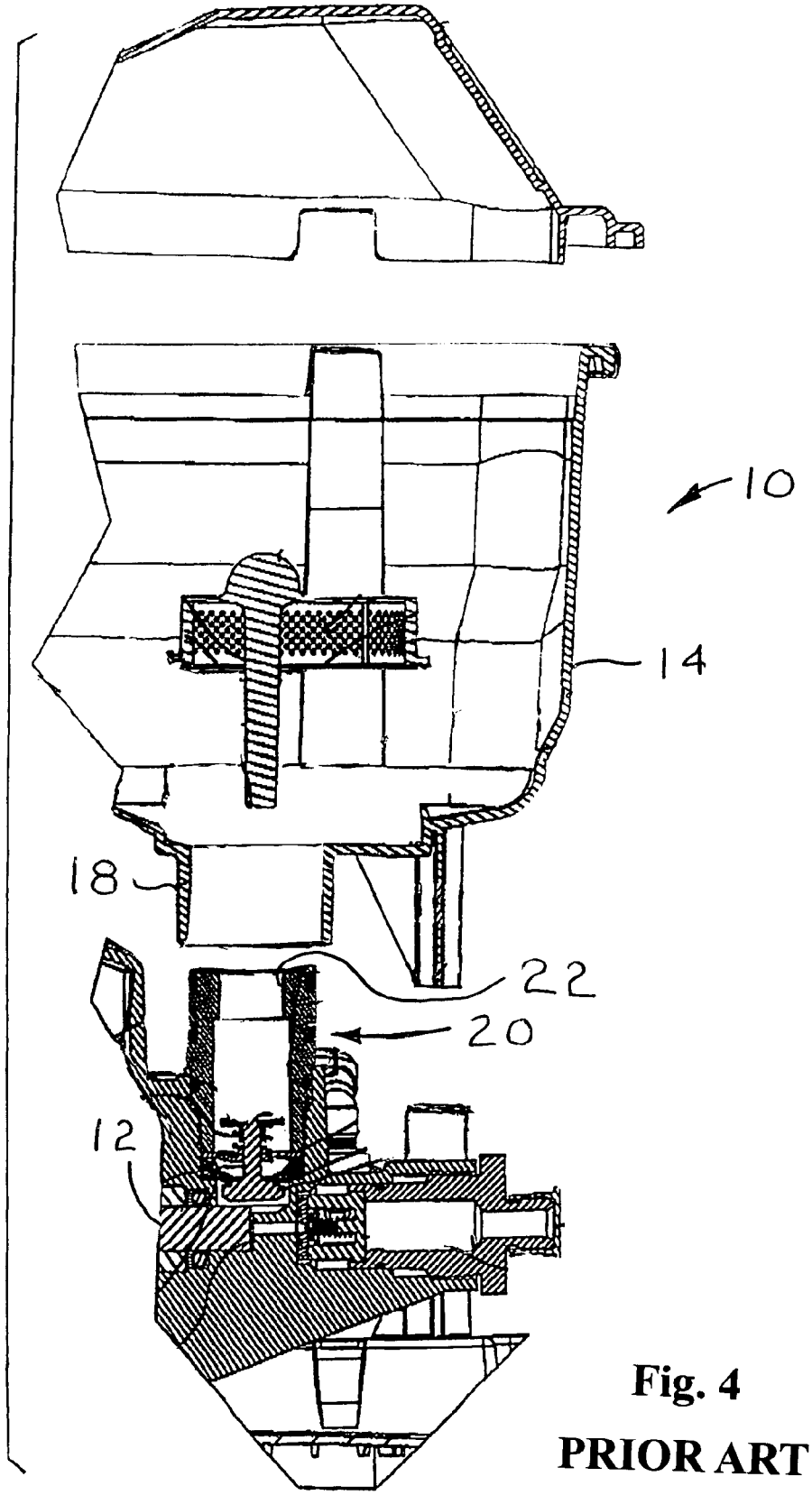
Fig. 4 PRIOR ART
FIG. 4 is an exploded fragmentary section view of the prior art parts shown in FIG. 3.

In prior art versions of this equipment, the hopper 14 was secured to the pump 12 using a pair of bolts 16, as shown most clearly in FIG. 2. While this provided a secure connection between the hopper 14 and the pump 12, it also meant that the user could not conveniently remove the hopper from the pump, especially when some paint remained in the hopper. Even if a user were to remove the bolts 16 so that the hopper 14 could be removed from the pump 12, any remaining paint in the hopper would then spill out of an outlet 18 of the hopper when the hopper was withdrawn from a paint pump inlet 22. FIG. 3 shows a partial cross section of the assembly 10 in an operating condition where the hopper outlet 18 is connected to a subjacent structure 20 including the pump inlet 22. FIG.

4 is a view similar to that of FIG. 3, except with the assembly partially exploded to illustrate that when the outlet 18 of the hopper 14 is separated from the pump inlet 22, any material remaining in the hopper 14 will be free to drain by gravity through the open outlet 18.

The prior art version of this equipment may thus be seen to have shortcomings in that the entire assembly 10 may be required to be lifted and tilted to empty excess paint remaining in the hopper 14 after spraying is completed. In addition, the hopper 14 is not readily removed from the remainder of assembly 10 for cleaning, thus increasing the risk that a user will spray the hopper 14 with a garden hose while the hopper is attached to the pump 12, which may undesirably subject the electric motor associated with the pump 12 to water overspray.

Figure 5:
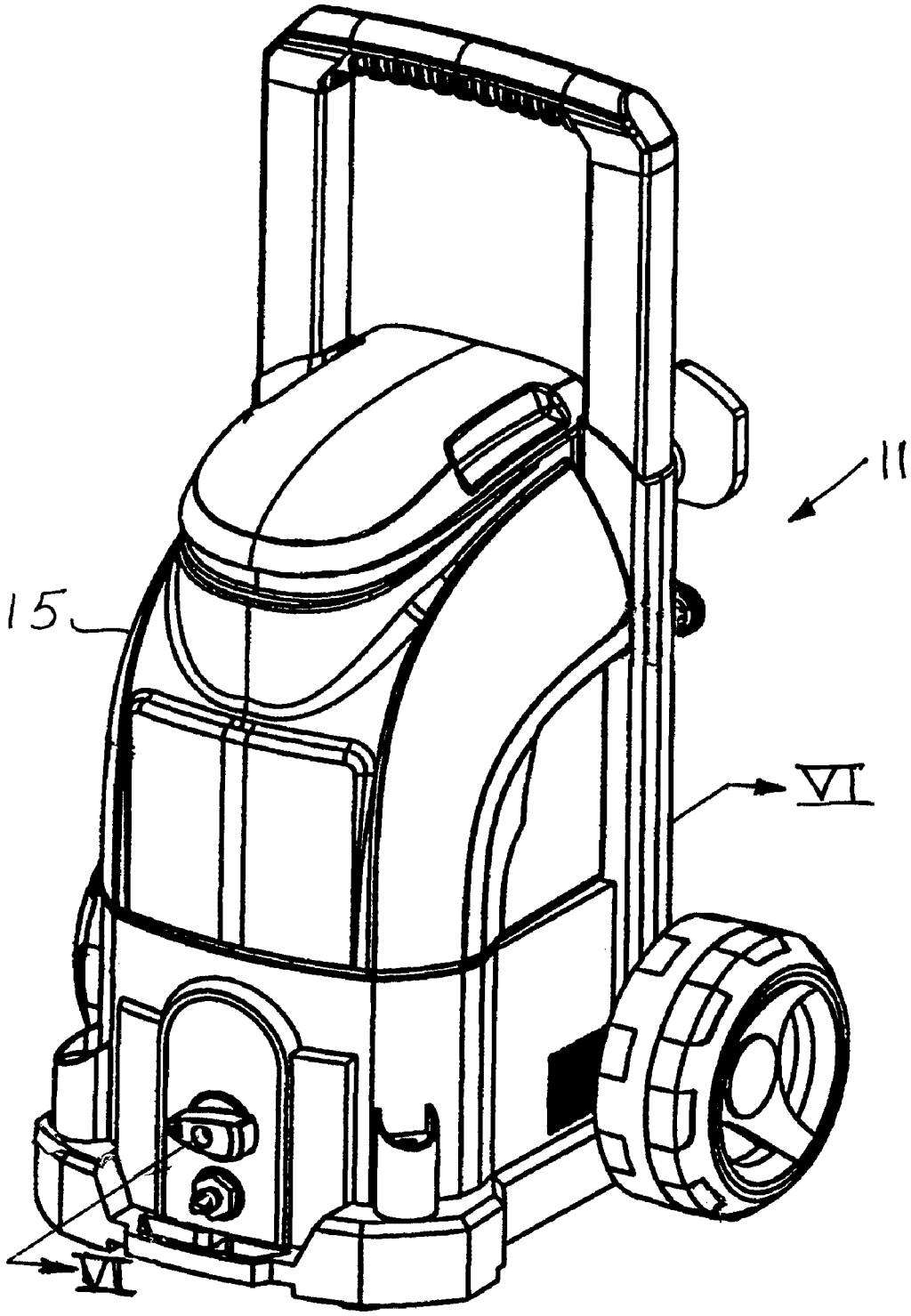
FIG. 5 is a perspective view from above and to the right of a paint spray pump with a user removable hopper useful in the practice of the present invention.
Figure 6:
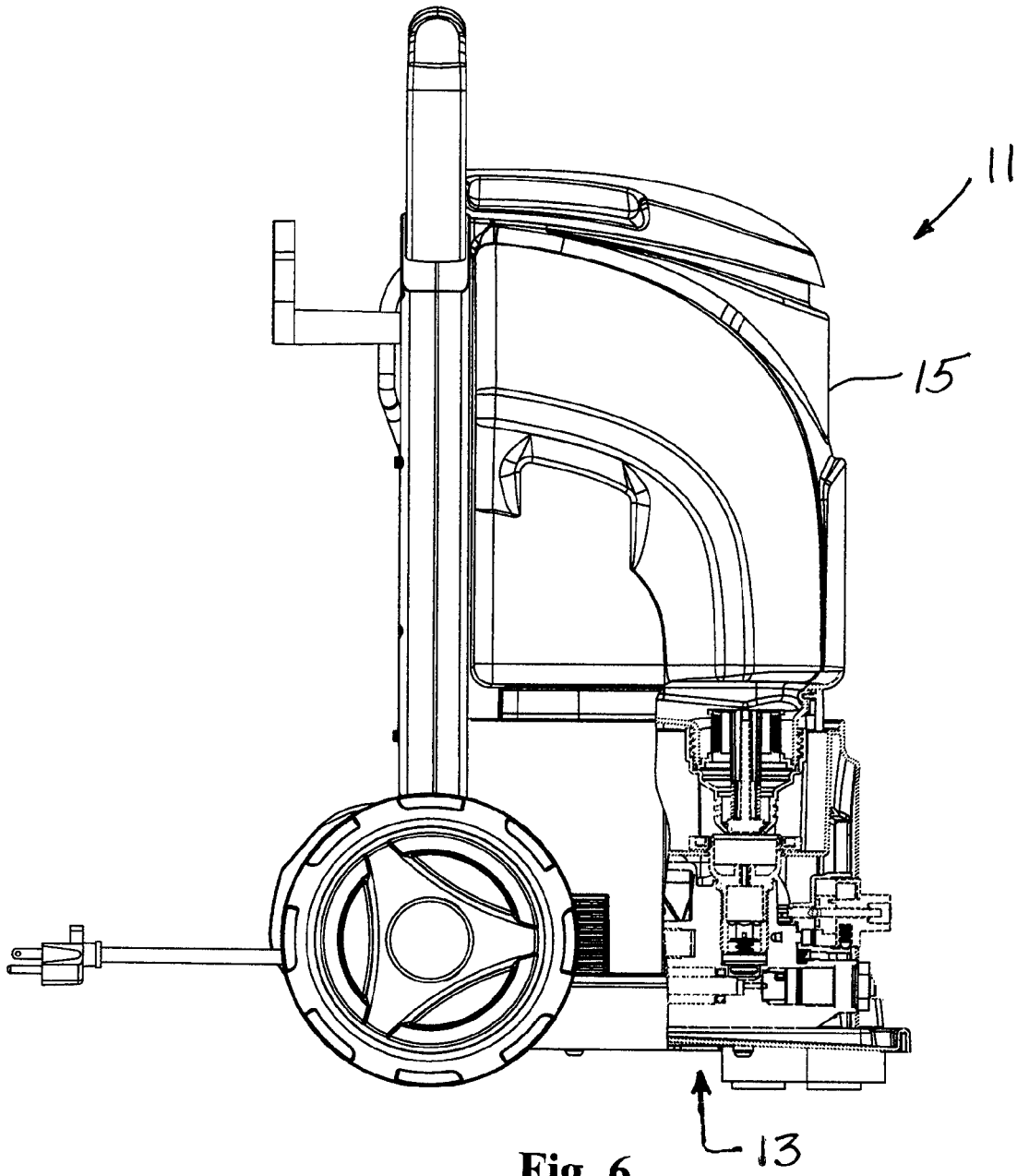
FIG. 6 is a side elevation view of the paint spray pump and hopper of FIG. 5, partly cut away and in section along line VI-VI.
Figure 7:
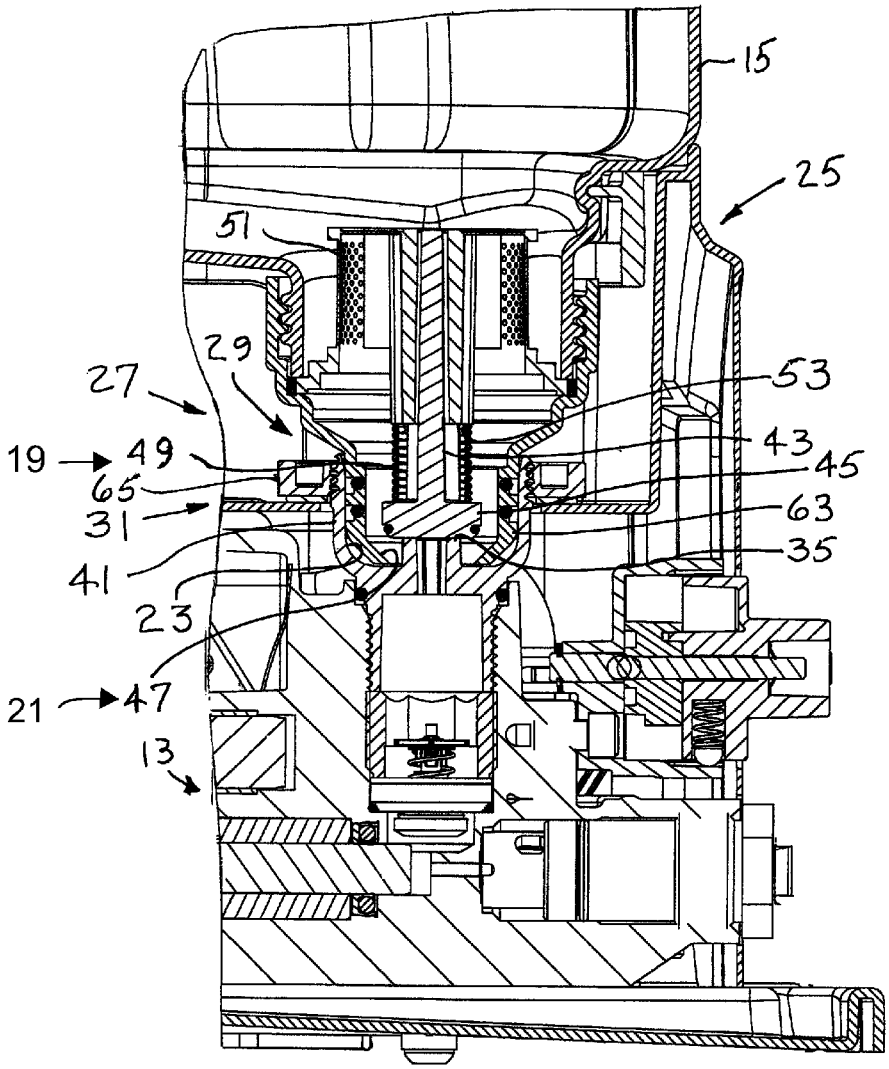
FIG. 7 is an enlarged view of the section view of FIG. 6, showing the hopper attached and with the disconnect valve open to provide fluid communication from the hopper to the pump.
Figure 8:
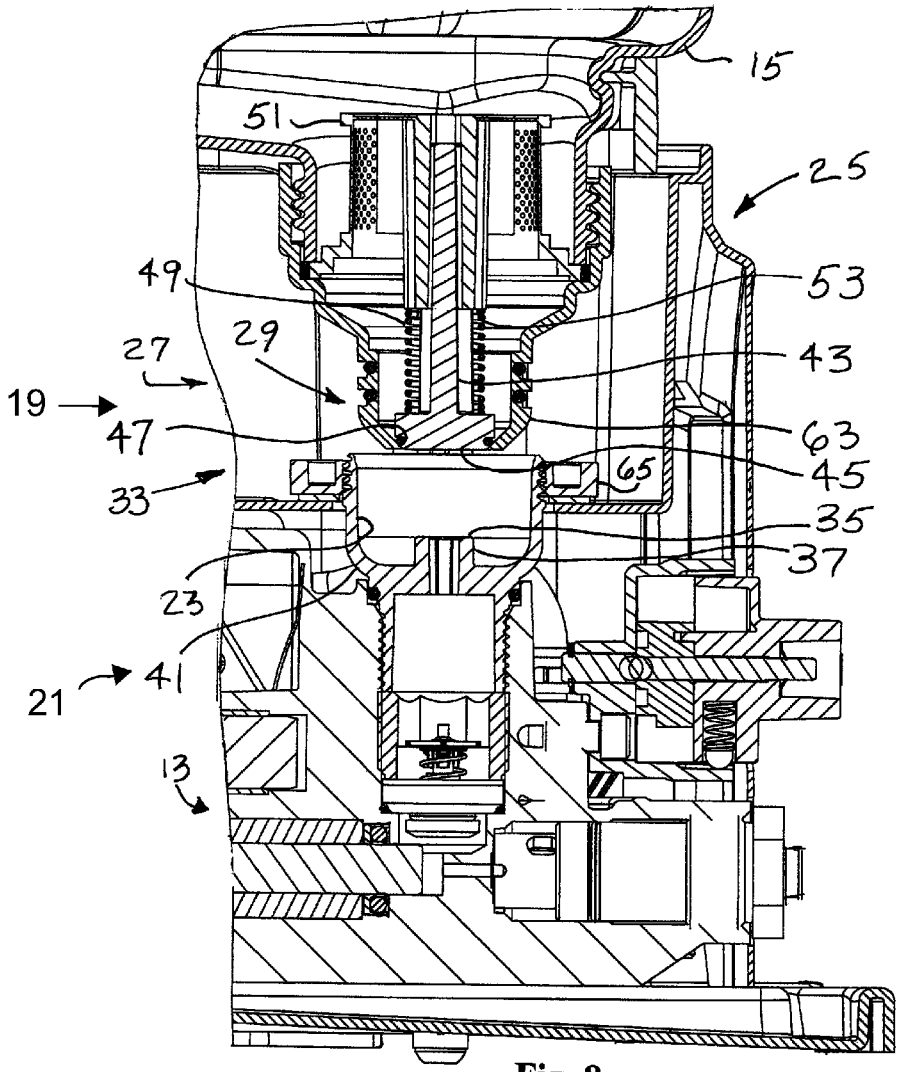
FIG. 8 is a view similar to that of FIG. 7, except with the hopper detached and with the disconnect valve closed to prevent liquid from draining from the hopper.

Referring now most particularly to FIGS. 5-8, a paint spray pump and hopper combination 11 useful in the practice of the present invention may be seen. In FIGS. 7 and 8 various details and aspects of this embodiment of a disconnect apparatus 25 for the present invention may be seen. Apparatus 25 automatically operates to open and close a gravity-type connection between the removable hopper 15 and a subjacent structure 21. The apparatus 25 includes an outlet 19 of the hopper 15 located at a lowermost portion 27 of the hopper and a valve 29 located in the outlet 19, with the valve automatically positioned to: i) an OPEN condition 31 (shown in FIG. 7) and ii) a CLOSED condition 33 (shown in FIG. 8), depending upon whether the hopper 15 is positioned on or removed from the pump 13.

The valve 29 is held in the OPEN condition 31 when the outlet 19 of the hopper 15 is connected to the subjacent structure 21, as is shown in FIG. 7. As shown in FIG. 8, the valve 29 moves to a closed condition 33 when the outlet 19 of the hopper 15 is removed from the subjacent structure 21. As shown in these Figures, the subjacent structure 21 may include a pump inlet 23.

As illustrated in FIG. 7, the apparatus 24 also may include means 35 for opening the valve 29 when the outlet 19 of the hopper 15 is connected to the subjacent structure 21. The means for opening the valve is mounted on the subjacent structure. The means for opening the valve includes the structure of a projection 37 extending toward the valve 29, more particularly the projection 37 may be formed as a part of an inlet sleeve 41. The valve 29 may have a stem 43 and a head 45 arranged to engage a seat 47 when the valve 29 is in the CLOSED condition 33. The outlet 19 is preferably, but not necessarily, cylindrical. In the operation of the valve 29 of the present invention, the projection 37 presses against the head 45 of the valve 29 to move the valve 29 to the OPEN condition 31 when the outlet 19 of the hopper 15 is connected to the pump inlet 23. A spring 49 urges the valve 29 toward the CLOSED condition 33 in which the head 45 seals against the seat 47, preventing flow from the outlet 19.

A strainer and valve guide 51 may be used to locate and support the valve 29 in the outlet 19. Guide 51 provides a reaction surface 53 against which spring 49 reacts to urge the valve 29 to the CLOSED condition 33.

A valve retainer 63 is preferably threaded onto the outlet 19 and secures the guide 51 to the outlet 19 of the hopper 15. Retainer 63 also preferably has valve seat 47 formed integrally therewith. The valve 29, valve guide 51 and valve retainer 63 may be formed of a polymeric material resistant to degradation in the presence of conventional paints and paint solvents, and other similar coating materials and their respective solvents.

Figure 9:
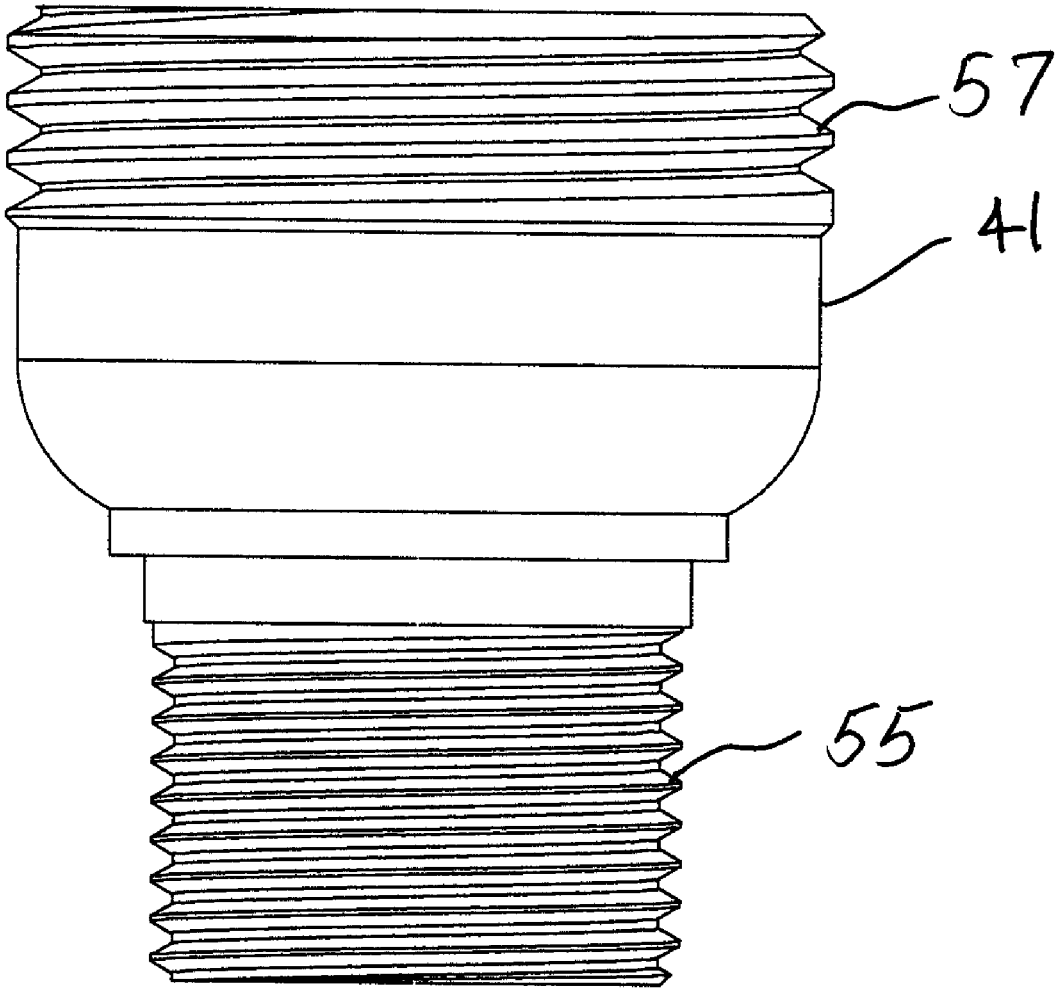
FIG. 9 is side elevation view of a pump inlet sleeve for the disconnect valve, useful in the practice of the present invention.
Figure 10:
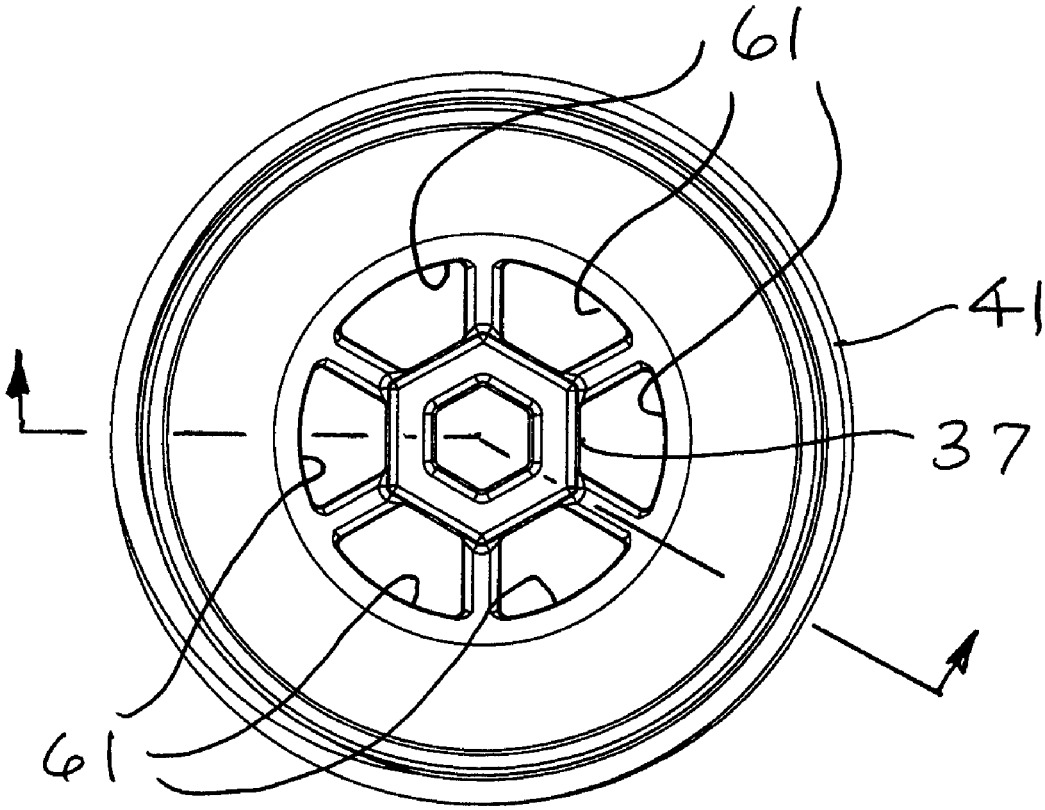
FIG. 10 is a top plan view of the pump inlet sleeve of FIG. 9.
Figure 11:
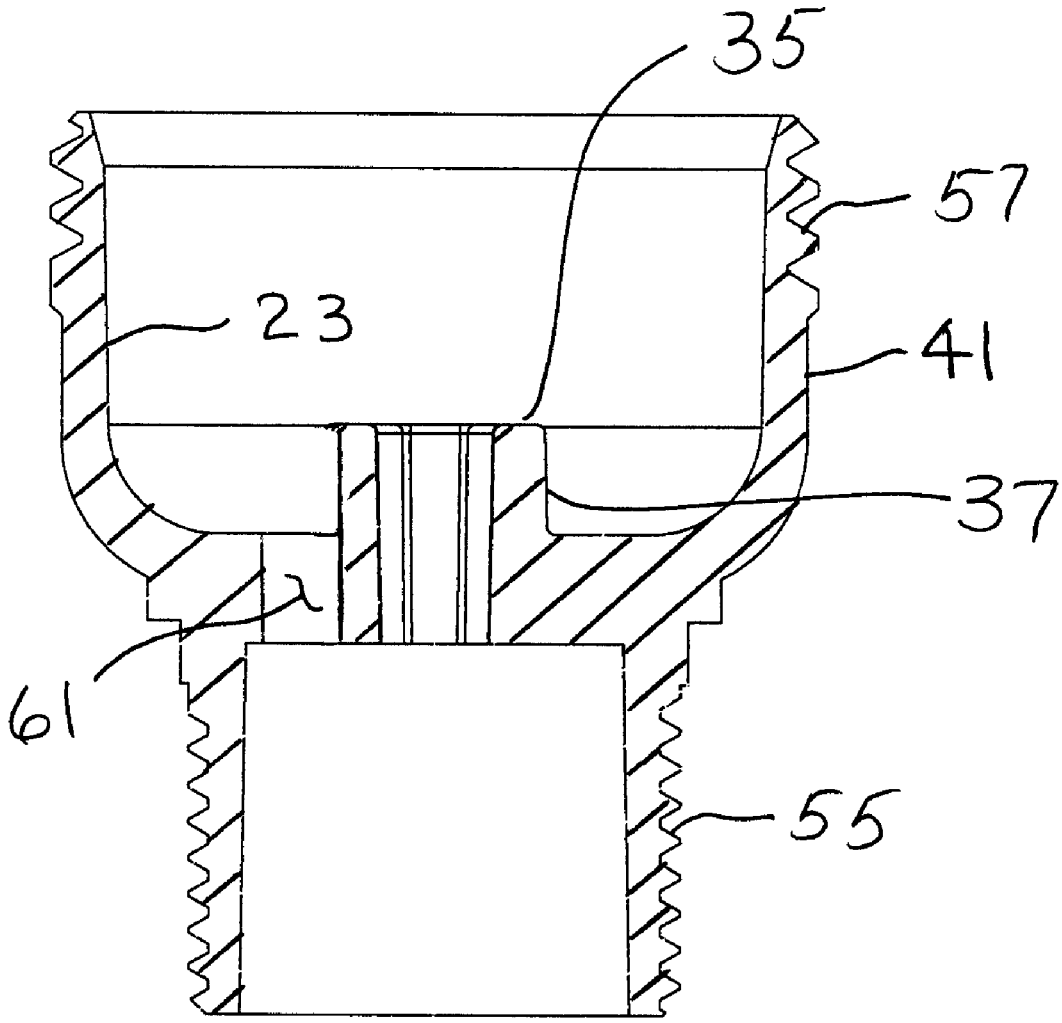
FIG. 11 is a side section view of the pump inlet sleeve taken along line XI-XI of FIG. 10.

Referring now to FIGS. 9, 10, and 11, various details of the inlet sleeve 41 may be seen. Sleeve 41 may form the pump inlet 23 and includes projection 37 surrounded by a plurality of apertures 61. Threads 55 may be used to secure sleeve 41 to the pump 13, and threads 57 may further secure sleeve 41 in a pump housing a threaded ring 65.

Figure 12:
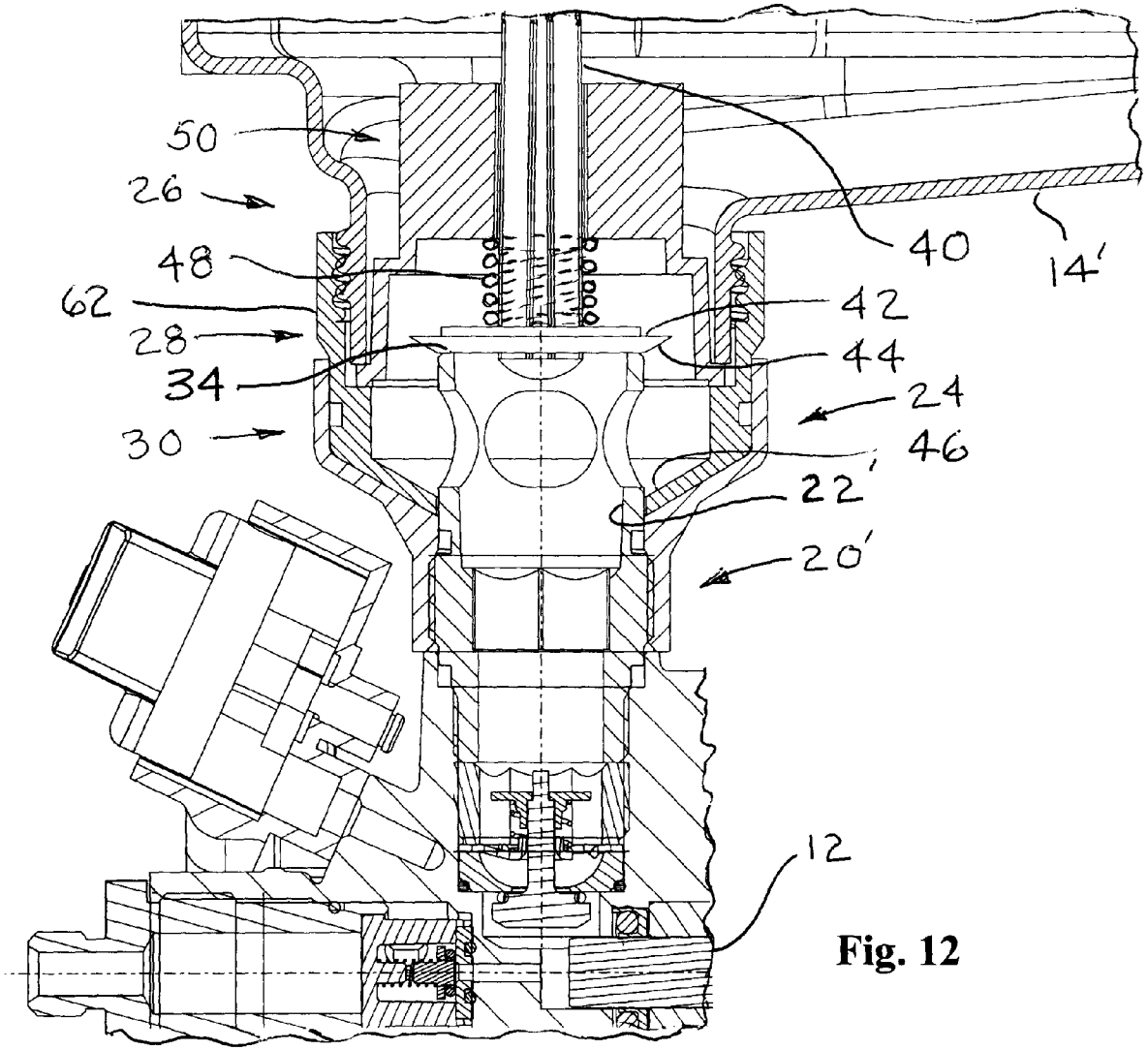
FIG. 12 is a fragmentary section view of a hopper outlet and paint pump inlet in an alternative embodiment of the present invention, shown with the outlet connected to the inlet in a normal operating condition.
Figure 13:
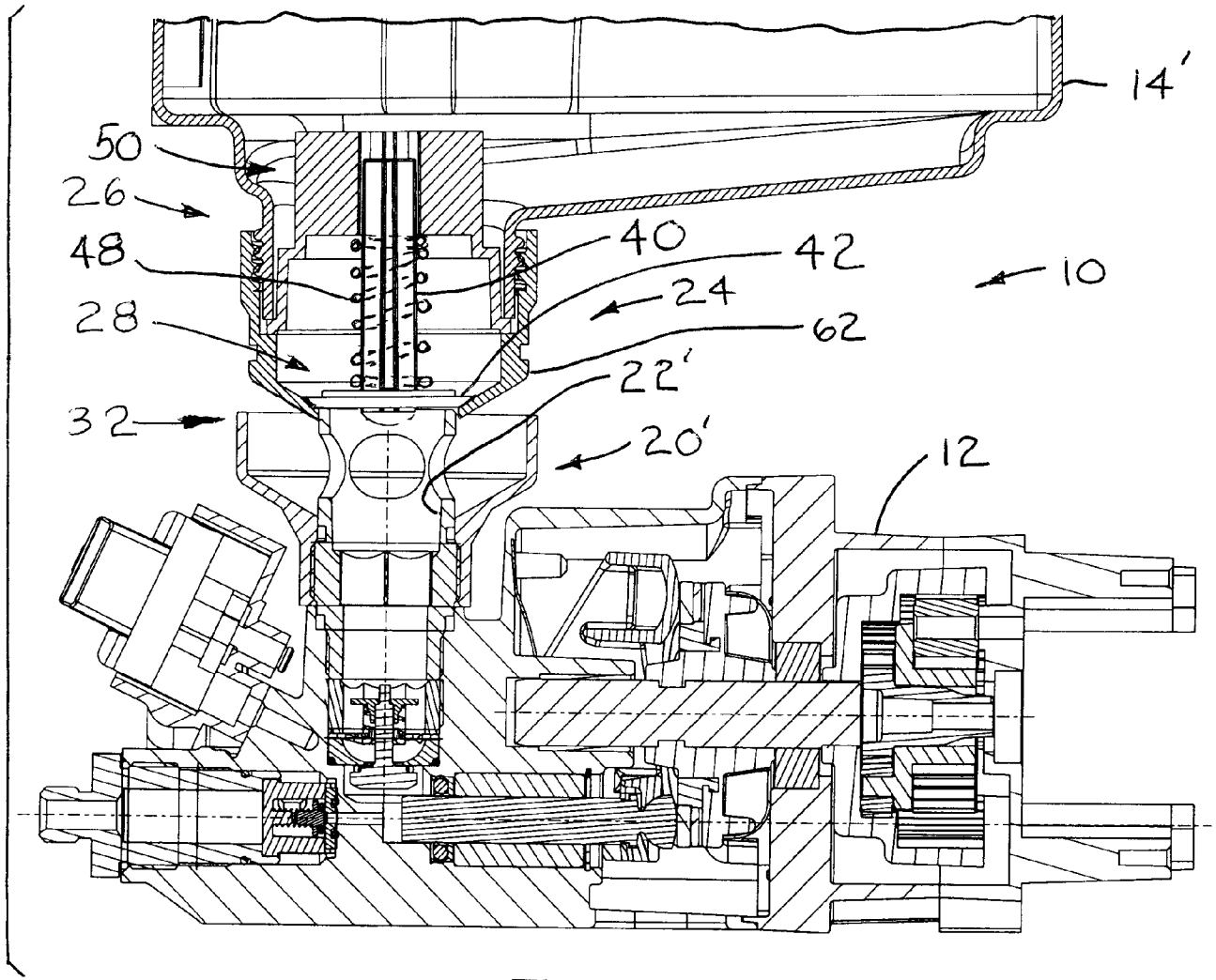
FIG. 13 is a view similar to that of FIG. 12, except with the hopper and hopper outlet partially displaced from the pump inlet in the process of being removed, to illustrate certain aspects of the present invention.
Figure 14:
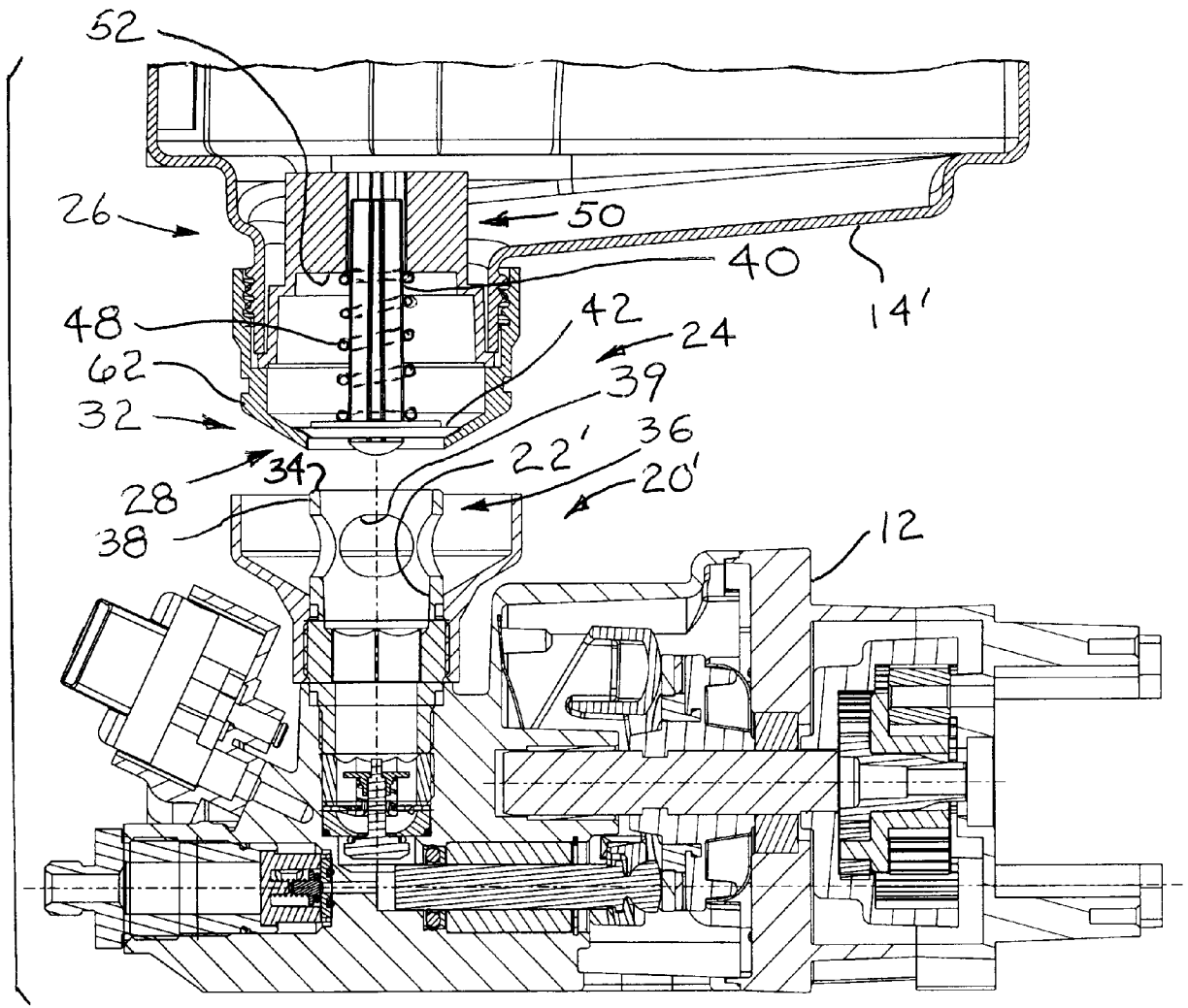
FIG. 14 is a view similar to that of FIG. 13, except with the hopper outlet fully separated from the pump inlet.

Various details and aspects of another embodiment of a disconnect apparatus 24 (similar to apparatus 25) useful in the practice of the present invention may be seen in FIGS. 12, 13 and 14. Apparatus 24 automatically operates (i.e., opens and closes) a gravity-type connection between a removable hopper 14' and a subjacent structure 20.' The apparatus 24 includes an outlet 18' of the hopper 14' located at a lowermost portion 26 of the hopper and a valve 28 located in the outlet 18', with the valve 28 positionable between OPEN and CLOSED conditions. The valve 28 is held in an OPEN condition 30 when the outlet 18' of the hopper 14' is connected to the subjacent structure 20,' as shown in FIG. 5. As shown in FIGS. 6 and 7, the valve 28 moves to a CLOSED condition 32 when the outlet 18' of the hopper 14 is removed from the subjacent structure 20.' As shown in these Figures, the subjacent structure 20' may include a pump inlet 22.'

As illustrated in FIG. 12, the apparatus 24 also may include means 34 for opening the valve 28 when the outlet 18' of the hopper 14' is connected to the subjacent structure 20.' The means for opening the valve is mounted on the subjacent structure. The means for opening the valve includes the structure of a projection 36 extending toward the valve 28, more particularly the projection 36 may be a perforated cylinder 38 having a plurality of apertures 39 circumferentially spaced around the cylinder 38. The valve 28 may be a poppet valve having a stem 40 and flange 42 with a rim 44 arranged to engage a seat 46 when the valve 28 is in the closed condition 32. The outlet 18' is preferably, but not necessarily, cylindrical. The valve 28 has a conical interface between the rim 44 and the seat 46, with the cone direction of the conical mating surfaces inverted from that of conventional poppet valves such as those commonly used as intake and exhaust valves in internal combustion engines. In the operation of the valve 28 of the present invention, the projection 36 presses against the flange 42 of the valve 28 to move the valve 28 to the OPEN condition 30 when the outlet 18' of the hopper 14' is connected to the pump inlet 22.' A spring 48 urges the valve 28 toward the CLOSED condition 32 in which the rim 44 seals against the seat 46, preventing flow from the outlet 18.'

Figure 15:
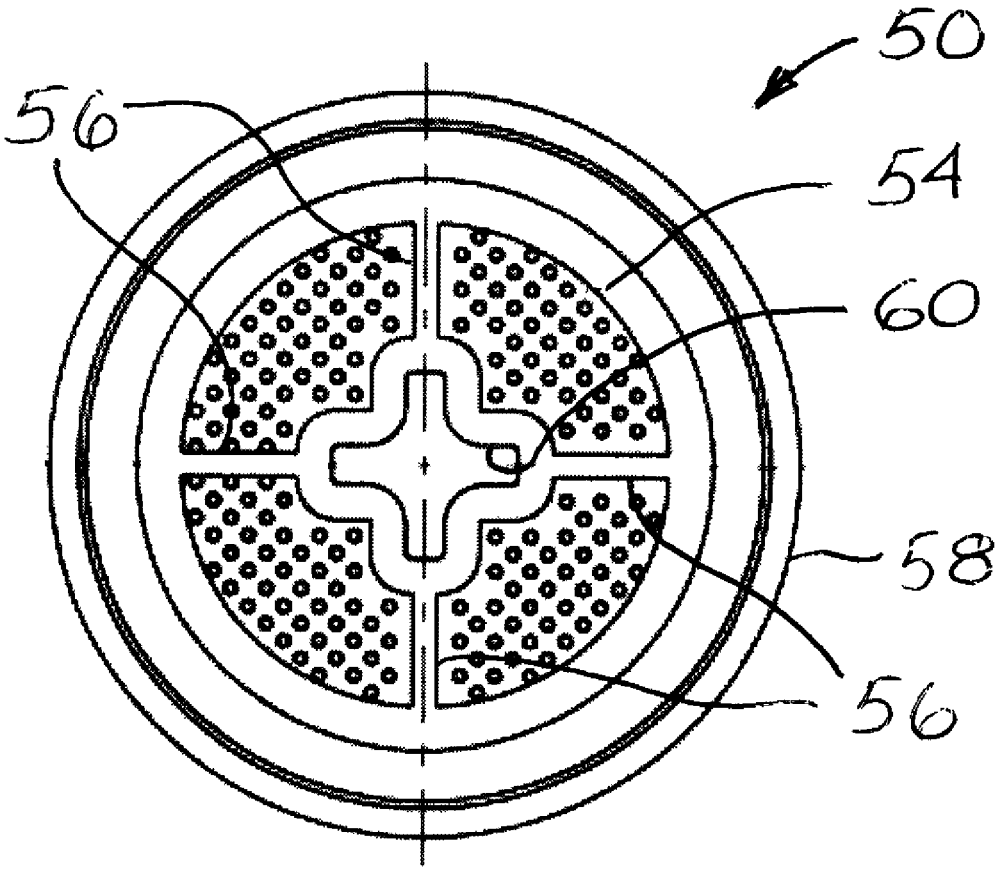
FIG. 15 is a top plan view of a strainer and valve guide shown in FIG. 12.
Figure 16:
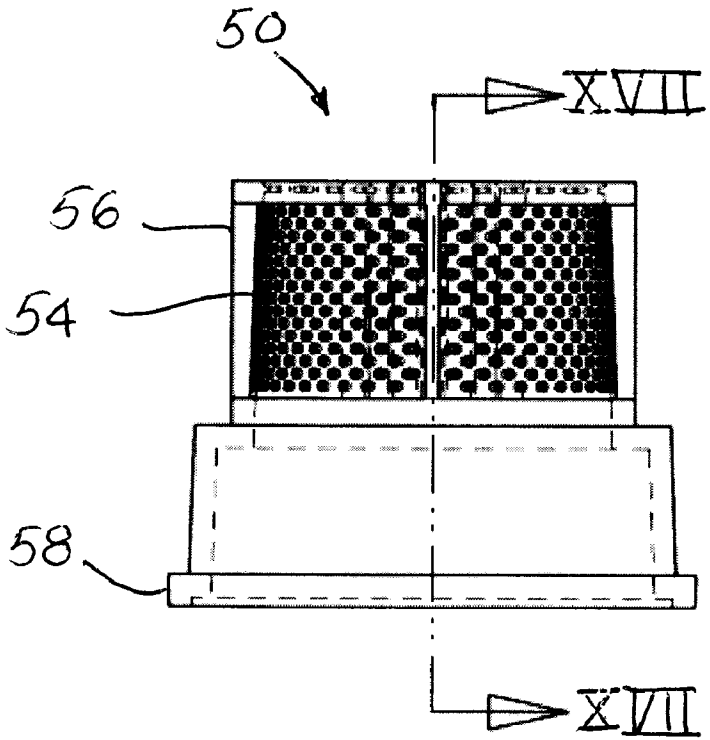
FIG. 16 is a side elevation view of the strainer and valve guide of FIG. 12.
Figure 17:
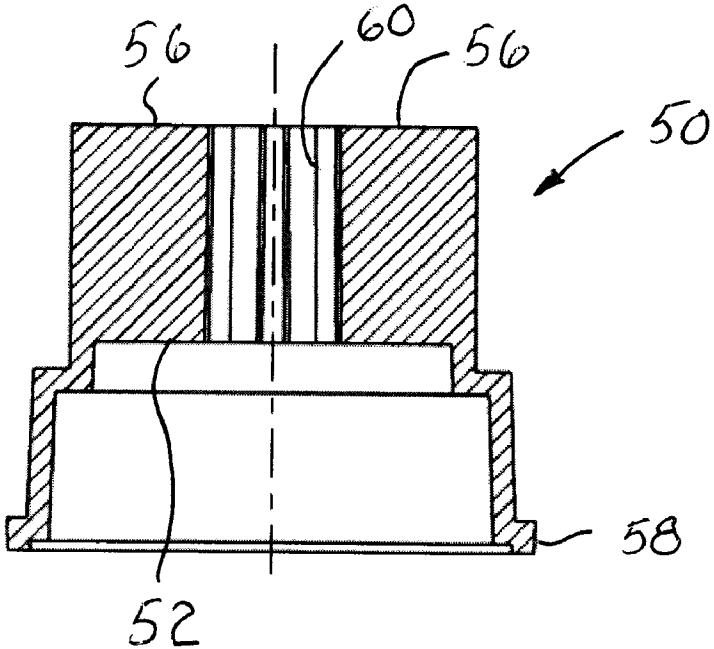
FIG. 17 is a section view taken along line XVII-XVII of FIG. 16.
Figure 18:
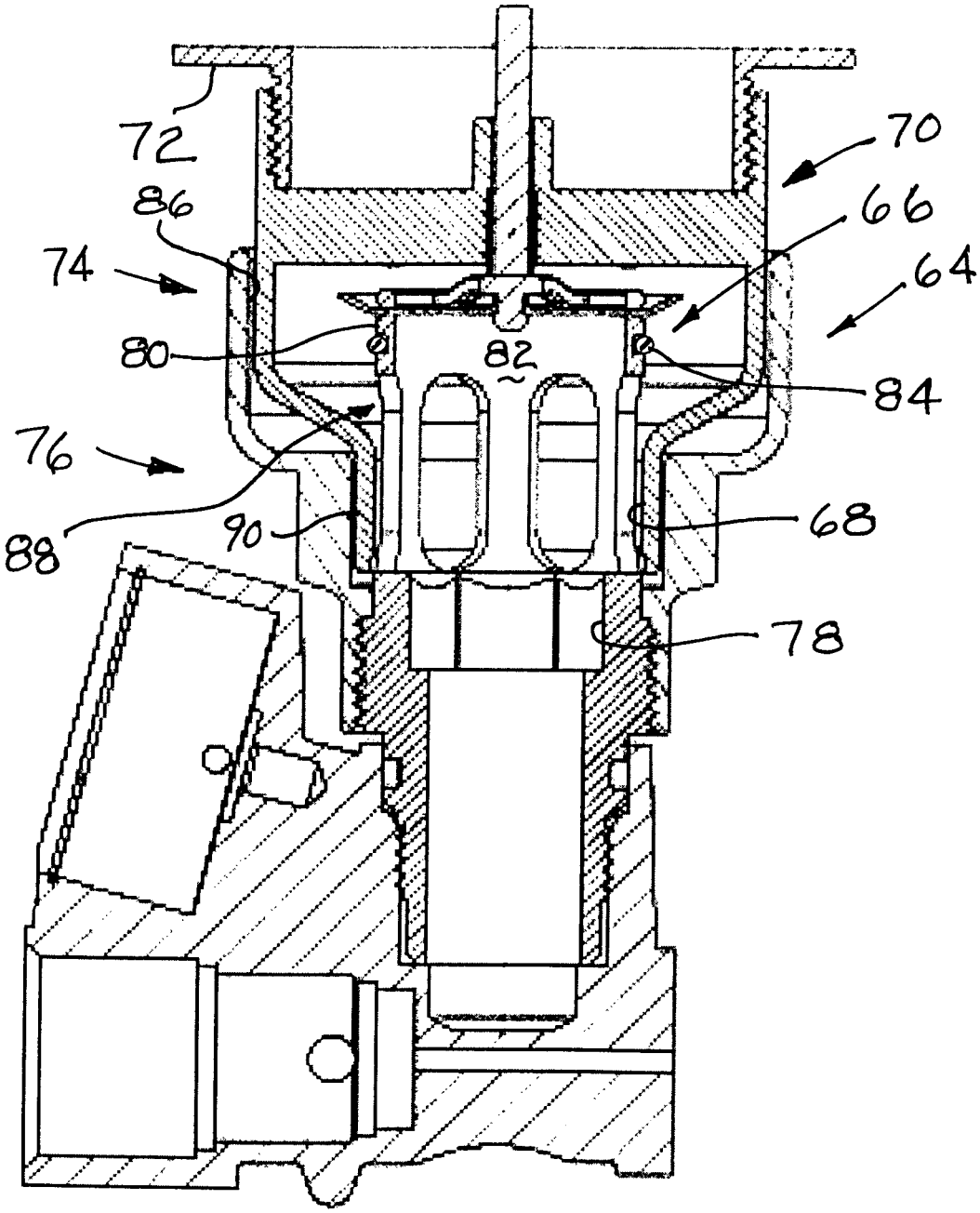
FIG. 18 is a fragmentary section view of a hopper outlet and paint pump inlet in a second embodiment of the present invention, with the outlet connected to the inlet in a normal operating condition.
Figure 19:
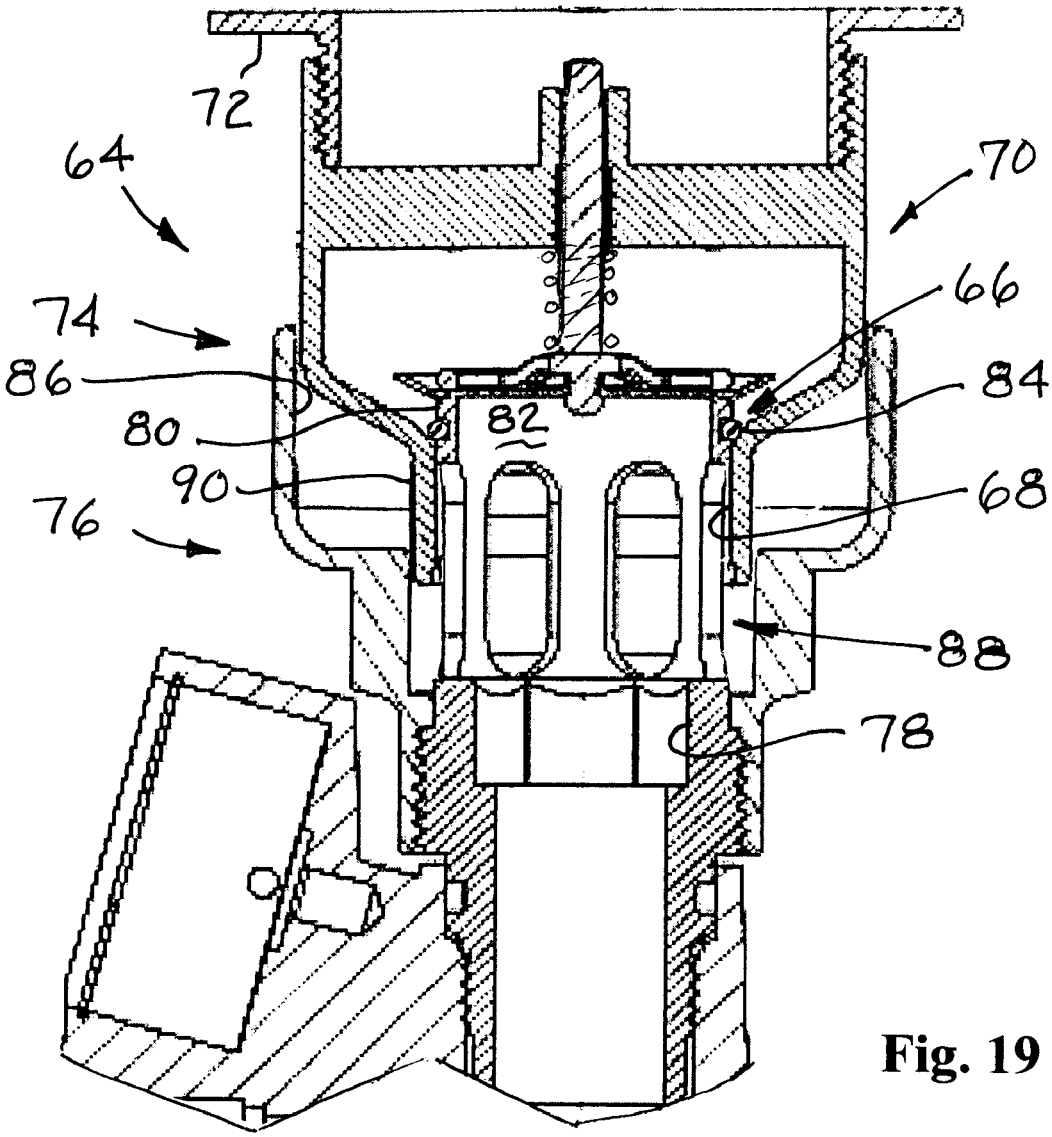
FIG. 19 is a view similar to that of FIG. 18, except with the hopper outlet partially displaced to a first intermediate position in the process of separating the hopper outlet from the paint pump inlet.
Figure 20:
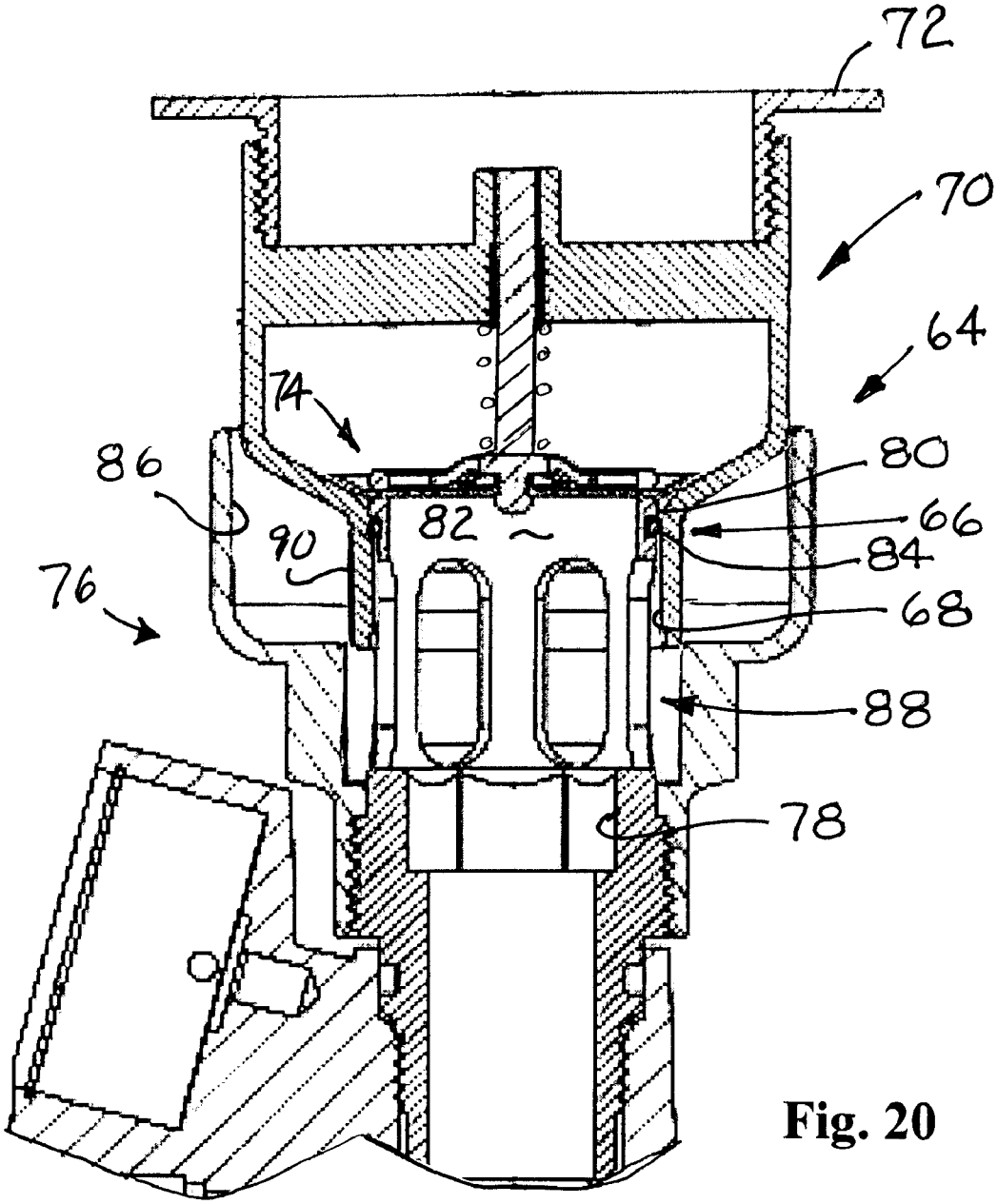
FIG. 20 is a view similar to that of FIG. 19, except with the hopper outlet further displaced to a second intermediate position in the process of separating the hopper outlet from the paint pump inlet.
Figure 21:
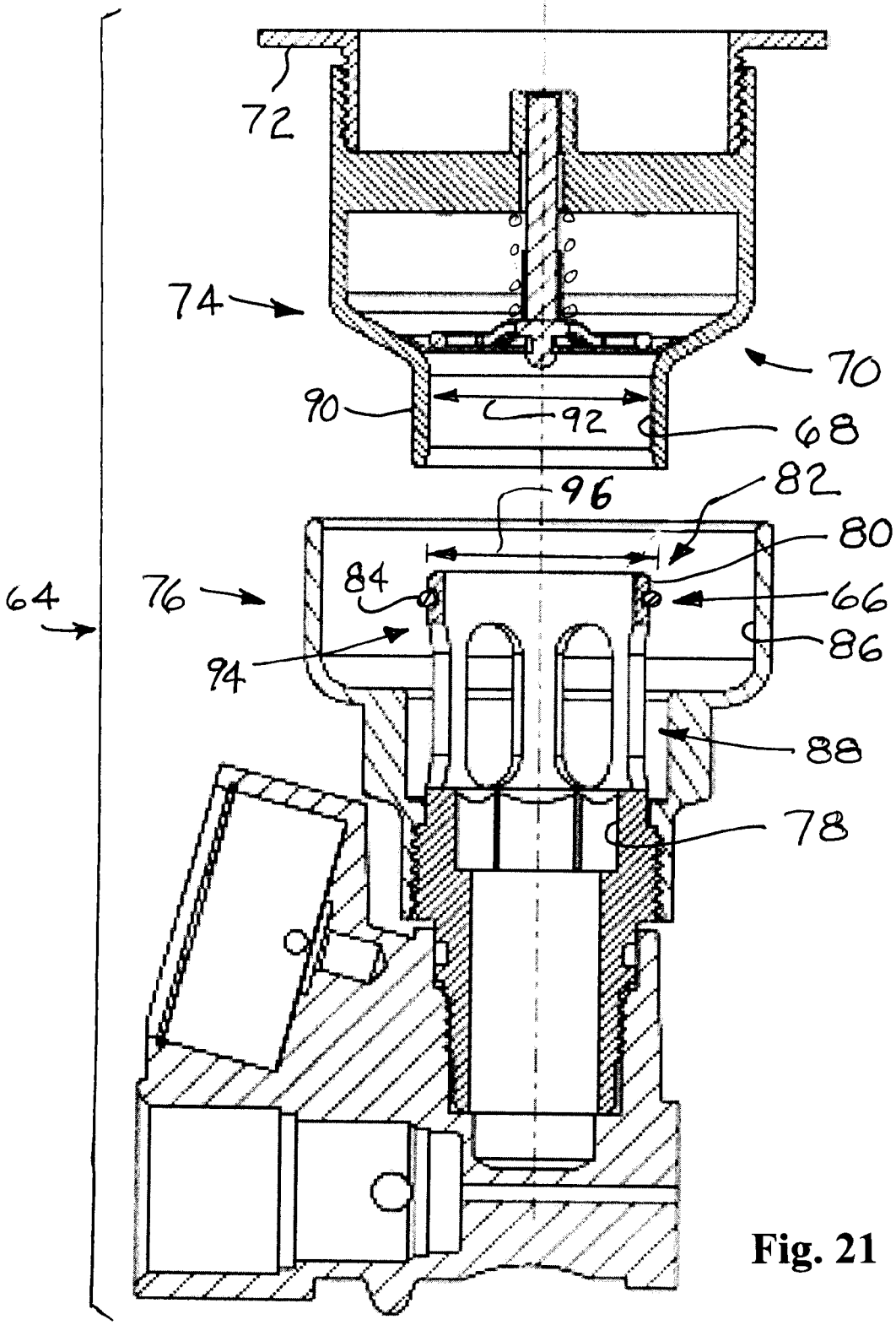
FIG. 21 is a view similar to that of FIG. 20, except with the hopper outlet fully separated from the pump inlet.

A strainer and valve guide 50 for this embodiment may be seen in various views in FIGS. 15, 16 and 17. Guides 50 and 51 are similar. As shown in FIGS. 12-14, guide 50 locates and support the valve 28 in the outlet 18.' Guide 50 provides a reaction surface 52 against which spring 48 reacts to urge the valve 28 to the closed condition 32. Guide 50 preferably has a perforated strainer portion 54 supported by a plurality of ribs 56 with a depending peripheral mounting flange 58 all integrally together. Guide 50 may have a cruciform opening 60 to receive the stem 40 in a sliding relationship. The stem 40 and opening 60 preferably have mating and loosely interfitting cruciform cross sections.

In the embodiment shown in FIGS. 12-14, valve retainer 62 is preferably threaded onto the outlet 18' and secures the flange 58 of the guide 50 to the outlet 18' of the hopper 14.' Retainer 62 also preferably has valve seat 46 formed integrally therewith. The valve 28, valve guide 50 and valve retainer 62 may be formed of a polymeric material resistant to degradation in the presence of conventional paints and paint solvents, and other similar coating materials and their respective solvents.

Referring now to FIGS. 18, 19, 20 and 21, a still further embodiment 64 of the disconnect apparatus of the present invention may be seen. This embodiment provides an additional feature of automatically wiping paint off an interior surface 68 of the hopper outlet 70 downstream of a shutoff valve 74 while removing the hopper. This has the advantage of reducing the risk of dripping paint as and after the hopper is removed. In the embodiment of FIGS. 18-21, the apparatus 64 includes means 66 for wiping the interior 68 of the outlet 70 of the hopper 72 below (downstream of) the shutoff valve 74 when the outlet 70 of the hopper is removed from a subjacent structure 76. The means for wiping 66 is preferably located on the subjacent structure 76. Structure 76 includes a paint pump inlet 78. The means for wiping 66 may include a peripheral surface 80 on a projection 82 mounted on the subjacent structure 76 and extending toward the valve. In one form, the means for wiping may include an O-ring 84.

The apparatus may further include an outer wall 86 connected to the subjacent structure 76 and surrounding the projection 82. As with the embodiment shown in FIG. 12, the projection 82 may include a perforated cylinder 88.

The outlet 70 may include a cylindrical extension 90 having a circular opening with an inner diameter 92. The projection 82 may include a cylindrical support 94 having an outer diameter 96 sized to closely interfit with the inner diameter 92 of the circular opening of the cylindrical extension 90 of the outlet 70. The means for wiping 66 comprises a circumferential surface on the cylindrical support 94. The cylindrical extension 90 has an axial length 98 and the projection 82 has a length 100 greater than the axial length 98 of the cylindrical extension 90, so that the O-ring 84 (or other means for wiping) will traverse the entire downstream area of the outlet 70 as the hopper 72 is withdrawn from the pump inlet 78, to provide complete wiping of the interior surface.

In another aspect, the present invention may be seen to be a method of providing a disconnect apparatus for a gravity-fed paint hopper comprising the steps of providing the paint hopper for containing paint, with the hopper located above the inlet of a paint pump and having an outlet located at the lowermost portion of the hopper, locating a valve in the outlet, urging the valve to an open condition when the hopper is connected to the inlet of the pump, and releasing the valve to move to the closed condition when the hopper is removed from the inlet of the pump. The invention may also include using a projection extending from the inlet of the pump to wipe paint from the outlet as the hopper is removed from the inlet of the pump.

In this method, the valve may be a poppet valve having a stem and the method may include guiding the stem of the valve as it moves. The method may also include wiping the bore, such as by using an edge of the projection to wipe the outlet. Alternatively, the method may use an O-ring mounted on the projection to wipe the outlet.

This invention is not to be taken as limited to all of the details thereof as modifications and variations thereof may be made without departing from the spirit or scope of the invention.

What is claimed is:

1. A paint spray pump and hopper combination having a gravity-type connection between a removable paint hopper and a paint spray pump, the paint spray pump and hopper combination comprising:

a paint spray pump having an upper portion;

an inlet sleeve threadedly engaged with the paint receiving opening of the spray pump;

a protrusion extending upwardly from the inlet sleeve;

a paint hopper removably securable to the paint spray pump above the upper portion of the paint spray pump, the paint hopper including at least one handle formed in the paint hopper for convenient removal of the paint hopper from the paint spray pump and for placement of the paint hopper on the paint spray pump;

a valve assembly threadedly engaged with a lower portion of the paint hopper and configured to be at least partially accommodated by the inlet sleeve, the lower portion of the paint hopper including an outlet, the valve assembly comprising:

a valve including a valve stem and a valve head;

a valve seat against which the valve head seals when the valve is in a closed position;

a spring disposed about the valve stem, the spring biasing the valve to the closed position; and a strainer and valve guide that locates and secures the valve relative to the outlet;

wherein the valve head engages the protrusion and moves the valve to an open position against a biasing force of the spring when the paint hopper is placed on the paint spray pump and wherein the spring causes the valve to automatically close when the paint hopper is lifted off of the paint spray pump.

2. The paint spray pump and hopper combination of claim 1 further comprising a pump inlet in the paint spray pump.

* * * * *